US008101559B2

(12) United States Patent
Mueller et al.

(10) Patent No.: US 8,101,559 B2
(45) Date of Patent: Jan. 24, 2012

(54) POLYALKYL (METH)ACRYLATE COPOLYMERS HAVING OUTSTANDING PROPERTIES

(75) Inventors: Michael Mueller, Bensheim (DE); Torsten Stoehr, Frankfurt (DE); Boris Eisenberg, Heppenheim (DE)

(73) Assignee: Rohmax Additives GmbH, Darmstadt (DE)

( * ) Notice: Subject to any disclaimer, the term of this patent is extended or adjusted under 35 U.S.C. 154(b) by 1014 days.

(21) Appl. No.: 11/815,624

(22) PCT Filed: Apr. 4, 2006

(86) PCT No.: PCT/EP2006/003032

§ 371 (c)(1),
(2), (4) Date: Aug. 6, 2007

(87) PCT Pub. No.: WO2006/105926

PCT Pub. Date: Oct. 12, 2006

(65) Prior Publication Data

US 2008/0146475 A1 Jun. 19, 2008

(30) Foreign Application Priority Data

Apr. 6, 2005 (DE) ..... 10 2005 015 931

(51) Int. Cl.
*C10M 145/14* (2006.01)
*C08F 20/28* (2006.01)

(52) U.S. Cl. ..... 508/469; 508/516; 526/328

(58) Field of Classification Search ..... 508/469, 508/516; 526/328
See application file for complete search history.

(56) References Cited

U.S. PATENT DOCUMENTS

| | | | | |
|---|---|---|---|---|
| 3,413,226 | A | 11/1968 | Coleman | |
| 4,021,357 | A | 5/1977 | Morduchowitz et al. | |
| 4,606,834 | A * | 8/1986 | Hart et al. | 508/471 |
| 4,880,880 | A | 11/1989 | Chen | |
| 5,095,071 | A | 3/1992 | Chen | |
| 5,139,882 | A * | 8/1992 | Elser et al. | 428/522 |
| 5,498,809 | A * | 3/1996 | Emert et al. | 585/13 |
| 5,756,433 | A * | 5/1998 | Auschra et al. | 508/469 |
| 6,409,778 | B1 * | 6/2002 | Auschra et al. | 44/388 |
| 2005/0148749 | A1 | 7/2005 | Scherer et al. | |
| 2005/0245406 | A1 | 11/2005 | Scherer et al. | |
| 2005/0261143 | A1 * | 11/2005 | Scherer et al. | 508/314 |
| 2006/0189490 | A1 * | 8/2006 | Dardin et al. | 508/469 |
| 2007/0191238 | A1 | 8/2007 | Fischer et al. | |
| 2007/0213237 | A1 | 9/2007 | Scherer et al. | |
| 2007/0219101 | A1 | 9/2007 | Scherer et al. | |
| 2009/0182145 | A1 | 7/2009 | Bohmke et al. | |

FOREIGN PATENT DOCUMENTS

| | | | |
|---|---|---|---|
| DE | 10249295 | A1 * | 5/2004 |
| DE | 10314776 | A1 * | 10/2004 |
| EP | 0 570 073 | | 11/1993 |
| EP | 0 708 170 | | 4/1996 |
| JP | 2000-510187 | | 8/2000 |
| JP | 2003-515633 | | 5/2003 |
| JP | 2003-516430 | | 5/2003 |
| JP | 2006-509082 | | 3/2006 |
| WO | 95 04763 | | 2/1995 |
| WO | WO 2004/087850 | A1 | 10/2004 |

OTHER PUBLICATIONS

U.S. Appl. No. 12/668,209, filed Jan. 8, 2010, Stoehr, et al.
U.S. Appl. No. 61/186,744, filed Jun. 12, 2009, Radano, et al.
U.S. Appl. No. 12/672,231, filed Feb. 4, 2010, Stoehr, et al.
U.S. Appl. No. 11/995,949, filed Jan. 17, 2008, Stoehr, et al.
U.S. Appl. No. 11/909,171, filed Sep. 20, 2007, Stoehr, et al.
U.S. Appl. No. 12/279,732, filed Aug. 18, 2008, Stoehr, et al.
Chinese Office Action issued Jun. 8, 2011, in Patent Application No. 200680005386.9 (with English-language translation).

* cited by examiner

*Primary Examiner* — Jim Goloboy
(74) *Attorney, Agent, or Firm* — Oblon, Spivak, McClelland, Maier & Neustadt, L.L.P.

(57) ABSTRACT

Copolymers are obtainable by polymerizing a monomer composition containing a) 0% to 40% by weight of one or more ethylenically unsaturated ester compounds of the formula (I), b) 10% to 99.9% by weight of one or more ethylenically unsaturated ester compounds of the formula (II), c) 0% to 80% by weight of one or more ethylenically unsaturated ester compounds of the formula (III), d) 0.1% to 30% by weight of one or more ethylenically unsaturated, polar ester compounds of the formula (IV), and e) 0% to 50% by weight of comonomer, based in each case on the total weight of the ethylenically unsaturated monomers.

35 Claims, No Drawings

POLYALKYL (METH)ACRYLATE COPOLYMERS HAVING OUTSTANDING PROPERTIES

The present invention relates to polyalkyl (meth)acrylate copolymers having outstanding properties.

The efficiency of modern gearboxes, engines or hydraulic pumps depends not only upon the properties of the machine parts but also greatly upon the frictional properties of the lubricant used. For the development of such lubricants, it is of particular importance to have knowledge of the action of the lubricant components used in relation to film formation and friction, and the selection of suitable additives can, for example, lead to lowering of the average fuel consumption of a vehicle by a few percent. In this context, particularly effective constituents of a lubricant include base oils having a particularly low viscosity and thus low inherent friction, and also organic friction modifiers. An example of this trend is the newest generation of what are known as fuel-economy engine oils of the SAE classes 5W-20, 5W-30 or 0W-20, which can be found analogously also for oils for manual and automatic gearboxes.

As a result of a development parallel to the fuel-saving lubricants, the use of friction-reducing additives has become even more important: the dimensions of modern gearbox and pump casings are distinctly smaller, they are cooled less, and both gearwheels and bearings have to bear higher loads. As a result, the operating temperatures are much higher than in the past. As a consequence, the tribological contact between two surfaces moving counter to one another has a reduced film thickness, and the lubricant and the additives present therein have to be capable of ensuring low frictional loss under these mixed friction conditions and of protecting the surfaces from wear. According to the current state of the art, it is assumed that typical oil-soluble friction-modifying lubricant additives either adsorb on the metal surface of a frictional contact or form reaction layers. The former consist typically of long-chain carboxylic acids and their salts, esters, ethers, alcohols, amines, amides and imides. The way in which such friction modifiers act is assumed to be alignment of the polar groups and associated film formation on the surface in frictional contact. Such a film then prevents the contact of the solid bodies when the actual oil film fails. The actual mechanism and the influence of polar interactions such as dipole-dipole interactions or hydrogen bonds has, however, not been conclusively explained.

Typical friction modifiers forming reaction layers are, for example, saturated fatty acid esters, phosphoric and triphosphoric esters, xanthogenates or sulfur-containing fatty acids. This class also includes compounds which, under the tribological stress in frictional contact, do not form solid but instead liquid reaction products having high load-bearing capacity. Examples thereof are unsaturated fatty acids, partial esters of dicarboxylic acids, dialkylphthalic esters and sulfonated olefin mixtures. The function of such friction-modifying additives is very similar to that of the EP additives, in the case of which the formation of a reaction layer in the lubricated gap wide has to proceed under relatively mild mixed friction conditions.

Furthermore, organometallic compounds such as molybdenum dithiophosphonates and dicarbamates, organic copper compounds, and also some solid lubricants such as graphite and $MoS_2$ may also function as friction-modifying additives in lubricants.

A disadvantage of these compounds is their quite high cost. Furthermore, many compounds are very polar, so that they do not dissolve in fully synthetic lubricant oils.

The frictional properties of lubricants which comprise oil-soluble polymers is the subject of several patents and publications. Only in a few cases is a relationship described between the specific frictional properties and the presence of polymers or VI improvers or their structure:

JP 05271331 claims the preparation of polymers and their use in lubricants. A copolymer is described of an $\alpha$-olefin and of a dibasic ester, and its reaction with alkanolamines, cycloalkanolamines, heterocyclic amines and polyalkylene polyamines. The lubricant comprising this random copolymer, compared to a reference, has a frictional coefficient reduced from 0.1104 to 0.07134, which is shown by the example of a Falex friction test (ASTM D 2714). A particular disadvantage of these polymers is their complex preparation.

JP 2000355695 (U.S. Pat. No. 6,426,323) describes lubricant compositions for continuous automatic gearboxes (CVTs) which comprise dispersing VI improvers. Preference is given to using polyalkyl methacrylates with dispersing comonomers such as dimethylaminoethyl methacrylate, 2-methyl-5-vinylpyridine and N-vinylpyrrolidone as VI improvers in order to obtain improved oxidation stability. Friction experiments on these lubricants are described by way of example, but there is no information on the influence of the abovementioned VI improvers.

EP 570073 describes boron-containing polyalkyl acrylates and methacrylates as lubricant additives which simultaneously have the effect of a VII and of a friction modifier. In this context, cyclic boron compounds which are known to be friction-modifying components are introduced randomly as functional groups into the side chains of customary PAMA VI improvers. As relevant tests, results of SRV (vibration-friction-wear) and LFW-1 tribometer (ASTM D 2714=Falex test) friction tests in comparison to commercial PAMA VI improvers are described. A disadvantage of these copolymers is their quite complicated preparation, so that such products to date are not used commercially on a larger scale.

EP 286996 (U.S. Pat. No. 5,064,546) claims lubricant compositions of a certain naphthene-based base oil composition, which contain 0.01-5% of a friction modifier and are suitable particularly for automatic and continuous gearboxes. VI improvers, in particular PAMAs, are mentioned as additional components, but their type is judged to be uncritical in relation to the frictional performance of the formulation.

U.S. Pat. No. 4,699,723 describes dispersing multifunctional VI improvers composed of ethylene-propylene copolymers (OCPs) to which a dispersing, antioxidative functional group is grafted. An influence of these VIIs on the frictional properties of the resulting lubricants is not described. In this case, generally random copolymers are obtained which do not have friction-improving properties.

U.S. Pat. No. 6,444,622 and U.S. Pat. No. 6,303,547 describe friction-modified lubricants, in which the frictional properties are influenced by the combination of improved classical friction modifiers, in this case a $C_5$-$C_{60}$ carboxylic acid, and an amine. The addition of polyalkyl methacrylate VI improvers is also claimed only in conjunction with the adjustment of the lubricant oil viscosity (SAE units) and the shear stability.

EP 0747464 describes a lubricant composition having long-lasting "anti-shudder" frictional properties for use in automatic gearboxes. The composition comprises alkoxylated fatty acid amines and also a mixture of other friction-modifying additives. Dispersing and nondispersing VI improvers are mentioned in the claims merely as further components of the lubricant without an influence on the frictional properties of the lubricant being described.

WO 00/58423 describes high-performance motor oils and other lubricants based on a mixture of a poly-alpha-olefin having high VI (HVI-PAO) and a relatively high molecular weight thickener (typically a hydrogenated poly(styrene-co-isoprene)), HSI, an ethylene-propylene copolymer (OCP) or a polyisobutylene (PIB) having a weight-average molecular weight $M_w$ of from 10 000 to 100 000 g/mol. Increased lubricant film thicknesses and good wear protection compared to the prior art are attributed to the claimed lubricants.

The authors emphasize that the use of customary high molecular weight VI improvers has considerable disadvantages owing to the non-newtonian behavior of the resulting oils. Thus, especially the thickness of the lubricant film in frictional contact is to be reduced owing to the high shear stress and the low temporary shear stability of such polymeric additives. This behavior of lubricants which comprise polymers is contradicted by the present invention.

U.S. Pat. No. 6,358,896 describes friction modifiers for motor oil compositions having improved fuel efficiency based on keto amides and keto esters. Polymeric viscosity index improvers are mentioned in the patent as components of such lubricants. Dispersing VIIs are mentioned only in relation to their action as dispersants.

WO 9524458 (U.S. Pat. No. 5,622,924) claim viscosity index improvers having a proportion of min. 70% by weight of alkyl methacrylates having not more than 10 carbon atoms. In addition to good low-temperature properties, the oils formulated with such VI improvers also possess improved low frictional properties when they are used in combination with a molybdenum-containing friction modifier.

JP 08157855 describes lubricants which comprise VI improvers which maximize the action of a molybdenum-based friction modifier. The same polymers as described in WO 9524458 are claimed.

U.S. Pat. No. 3,925,217 claims lubricants consisting of compounds which possess one or two cyclohexyl rings and ensure an improved film thickness in frictional contact of roller bearings.

N.B.: This patent is the basis of what are known as traction fluids, i.e. lubricants which, owing to their frictional properties in the hydrodynamic region (at high speeds), can transfer forces via the frictional contact. Desired here are particularly high traction and frictional coefficients in order to make the force transfer as efficient as possible.

From this are derived a series of patents which also describe polymers, polyalkyl acrylates or methacrylates or other VI improvers with cyclic structures. These include, for example:

WO 8902911/EP 339088

JP 61044997

JP 61019697

However, the contents of these patents relate to the achievement of a maximum frictional/traction coefficient under the abovementioned hydrodynamic conditions under which the frictional contact is separated completely by a lubricant film. Even though the influence of the frictional properties is important for these liquids, the effect of the oils, additives and in particular VI improvers is the opposite of that of those which are intended to have a friction-modifying action in the field of mixed friction. Thus, the traction properties of polymer solutions were investigated by Kyotani et al. who found that polymers having cyclic side chains exhibit a tendency to higher frictional/traction coefficients (Kyotani, T.; Yamada, Y.; Tezuka, T.; Yamamoto, H.; Tamai, Y.; *Sekiyu Gakkaishi* (1987), 30(5), 353-8).

In the scientific literature, statements, some of them controversial, on the influence of polymers on the frictional performance of lubricants can be found:

From his friction experiments on lubricant oils for automatic gearboxes, Kugimiya comes to the conclusion that viscosity index improvers, both polyalkyl methacrylates and olefin copolymers, have no influence on the frictional properties of the oils (Kugimiya, T.; *Toraiborojisuto* (2000), 45(5), 387-395).

Similar results are obtained by Rodgers et al. for polyalkyl methacrylates, their N-vinylpyrrolidone copolymers and polyisobutylene in lubricant applications for automatic gearboxes (Rodgers, John J.; Gallopoulos, Nicholas E; *ASLE Trans*. (1967), 10(1), 102-12, discussion 113-14). Neither polyalkyl methacrylates nor PIB exhibit a change in the frictional characteristics (frictional curve). Only PMA-N-vinylpyrrolidone copolymers lead, if anything, to a lowering in the static frictional coefficient. However, this behavior was attributed solely to the higher viscosity of the oils investigated in the study and comprising VI improvers, and not to the structure of the polymer.

Gunsel et al. report some VI improvers which form up to 20 nm-thick films in frictional contacts and can thus shift the attainment of the limiting friction range to slower sliding and rolling speeds (Gunsel, S.; Smeeth, M.; Spikes, H.; *Society of Automotive Engineers*, (1996), SP-1209 (Subjects in Engine Oil Rheology and Tribology), 85-109). In this study, no correlation between the structure of the polymers and their influence on the actual frictional performance of the lubricant mixture is given.

In contrast, Sharma et al. find that viscosity index improvers, in particular polyalkyl methacrylates in PAO, make no significant contribution to the film thickness of the lubricant in a frictional contact (Sharma, S.-K.; Forster, N.-H.; Gschwender, L.-J.; *Tribol. Trans*. (1993), 36(4), 555-64).

From his wear experiments, Yoshida even concludes that polyalkyl methacrylates accumulate before the actual lubricant gap of a frictional contact at high loads, and lead to oil depletion and thus to high friction in the lubricant gap (Yoshida, K.; *Tribol. Trans*. (1990), 33 (20), 229-37).

A problem with the known friction modifiers is thus their cost. In addition, the solubility of many known friction-modifying additives in new types of fully synthetic oils is low.

Furthermore, many of the above-described additives function merely as friction modifiers. However, it is desirable that an additive imparts further favorable properties to a base oil. This allows the overall addition of additives to be reduced, which can save further costs.

In view of the prior art, it is thus an object of the present invention to provide highly effective friction-modifying additives which can be produced particularly inexpensively. It is a further object of the present invention to provide additives which have high dispersibility, high corrosion protection (i.e. good metal-deactivator properties), high stability toward oxidation and thermal stress, and also a high shear resistance. In addition, the additives should also be soluble in large amounts in very nonpolar lubricant oils, for example in fully synthetic oils. It is a further object of the present invention to provide additives which, in addition to a friction-modifying action, additionally improve the flow properties of the lubricant oil, i.e. have a viscosity index-improving action.

These and further objects which are not specified explicitly but which can be derived or discerned directly from the connections discussed by way of introduction herein are achieved by copolymers having all features of claim 1. Appropriate modifications of the inventive copolymers are protected in the claims dependent upon claim 1.

By virtue of the inventive copolymers obtainable by polymerizing a monomer composition which consists of a) from 0 to 40% by weight of at least one ethylenically unsaturated ester compound of the formula (I)

(I)

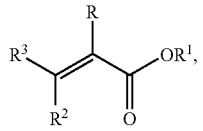

in which R is hydrogen or methyl, $R^1$ is a linear or branched alkyl radical having from 1 to 5 carbon atoms, $R^2$ and $R^3$ are each independently hydrogen or a group of the formula —COOR' in which R' is hydrogen or an alkyl group having from 1 to 5 carbon atoms, b) from 10 to 99.9% by weight, based on the total weight of the ethylenically unsaturated monomers, of at least one ethylenically unsaturated ester compound of the formula (II)

(II)

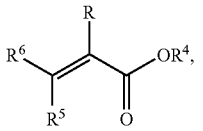

in which R is hydrogen or methyl, $R^4$ is a linear or branched alkyl radical having from 6 to 15 carbon atoms, $R^5$ and $R^6$ are each independently hydrogen or a group of the formula —COOR" in which R" is hydrogen or an alkyl group having from 6 to 15 carbon atoms, c) from 0 to 80% by weight of at least one ethylenically unsaturated ester compound of the formula (III)

(III)

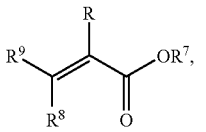

in which R is hydrogen or methyl, $R^7$ is a linear or branched alkyl radical having from 16 to 30 carbon atoms, $R^8$ and $R^9$ are each independently hydrogen or a group of the formula —COOR'" in which R'" is hydrogen or an alkyl group having from 16 to 30 carbon atoms, d) from 0.1 to 30% by weight of at least one ethylenically unsaturated, polar ester compound of the formula (IV)

(IV)

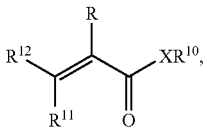

in which R is hydrogen or methyl, X is oxygen, sulfur or an amino group of the formula —NH— or —$NR^a$— in which $R^a$ is an alkyl radical having from 1 to 40 carbon atoms, $R^{10}$ is a radical which comprises from 2 to 1000 carbon atoms and has at least 2 heteroatoms, $R^{11}$ and $R^{12}$ are each independently hydrogen or a group of the formula —COX'$R^{10'}$ in which X' is oxygen or an amino group of the formula —NH— or —$NR^{a'}$— in which $R^{a'}$ is an alkyl radical having from 1 to 40 carbon atoms, and $R^{10'}$ is a radical comprising from 1 to 100 carbon atoms, e) from 0 to 50% by weight of comonomer, based in each case on the total weight of the ethylenically unsaturated monomers, it is possible in a not immediately foreseeable manner to provide additives for lubricant oil compositions with which the problems detailed above can be reduced in a simple manner.

At the same time, the inventive copolymers can achieve a series of further advantages. These include:

- The inventive copolymers exhibit outstanding properties as viscosity index improvers. The viscosity index-improving action is exhibited, for example, with reference to the kinematic viscosities at 40° C. and 100° C. to ASTM D 2270.
- In addition, the inventive copolymers have outstanding low-temperature properties in lubricant oil compositions. The low-temperature properties can be obtained by mini-rotational viscometry values (MRV), which can be obtained to ASTM D 4684, and scanning Brookfield results, as arise according to ASTM D 5133. A pour point-improving action of the inventive copolymers can be determined, for example, to ASTM D 97.
- If particular flow properties are to be achieved at a predetermined temperature, this can be achieved with very small amounts of copolymer of the present invention.
- The inventive copolymers have outstanding frictional properties. As a result, these copolymers protect surfaces from wear.
- The copolymers of the present invention exhibit outstanding dispersion properties. As a result, these copolymers prevent formation of deposits.
- The copolymers provide excellent corrosion protection properties, i.e. metal deactivator properties.
- The inventive copolymers bind metal ions in an outstanding manner. This reduces premature oxidation of lubricant oil compositions.
- The inventive copolymers can be prepared inexpensively.
- The copolymers exhibit high oxidation stability and are chemically very stable.

The compositions from which the inventive copolymers are obtained comprise especially (meth)acrylates, maleates and/or fumarates which have different alcohol radicals. The expression "(meth)acrylates" encompasses methacrylates and acrylates, and also mixtures of the two. These monomers are widely known. The alkyl radical may be linear, cyclic or branched.

Mixtures from which the inventive copolymers are obtainable may contain from 0 to 40% by weight, in particular from 0.5 to 20% by weight, based on the total weight of the ethylenically unsaturated monomers, of one or more ethylenically unsaturated ester compounds of the formula (I)

(I)

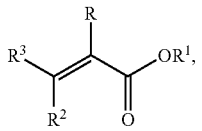

in which R is hydrogen or methyl, $R^1$ is a linear or branched alkyl radical having from 1 to 5 carbon atoms, $R^2$ and $R^3$ are each independently hydrogen or a group of the formula —COOR' in which R' is hydrogen or an alkyl group having from 1 to 5 carbon atoms.

Examples of component a) include (meth)acrylates, fumarates and maleates which derive from saturated alcohols, such as methyl(meth)acrylate, ethyl (meth)acrylate, n-propyl(meth)acrylate, isopropyl (meth) acrylate, n-butyl(meth)acrylate, tert-butyl (meth)acrylate and pentyl(meth)acrylate;

cycloalkyl(meth)acrylates such as cyclopentyl(meth)acrylate;

(meth)acrylates which derive from unsaturated alcohols, such as 2-propynyl(meth)acrylate, allyl(meth)acrylate and vinyl (meth)acrylate.

As a further constituent, the compositions to be polymerized may contain from 10 to 99.9% by weight, in particular from 20 to 95% by weight, based on the total weight of the ethylenically unsaturated monomers, of one or more ethylenically unsaturated ester compounds of the formula (II)

(II)

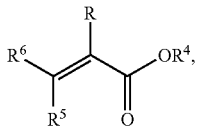

in which R is hydrogen or methyl, $R^4$ is a linear or branched alkyl radical having from 6 to 15 carbon atoms, $R^5$ and $R^6$ are each independently hydrogen or a group of the formula —COOR" in which R" is hydrogen or an alkyl group having from 6 to 15 carbon atoms.

These include (meth)acrylates, fumarates and maleates which derive from saturated alcohols, such as hexyl(meth)acrylate, 2-ethylhexyl (meth)acrylate, heptyl(meth)acrylate, 2-tert-butylheptyl (meth)acrylate, octyl(meth)acrylate, 3-isopropylheptyl (meth)acrylate, nonyl(meth)acrylate, decyl(meth)acrylate, undecyl(meth)acrylate, 5-methylundecyl(meth)acrylate, dodecyl(meth)acrylate, 2-methyldodecyl(meth)acrylate, tridecyl(meth)acrylate, 5-methyltridecyl(meth)acrylate, tetradecyl (meth)acrylate, pentadecyl(meth)acrylate;

(meth)acrylates which derive from unsaturated alcohols, for example oleyl(meth)acrylate;

cycloalkyl(meth)acrylates such as 3-vinylcyclohexyl (meth) acrylate, cyclohexyl(meth)acrylate, bornyl (meth)acrylate; and also the corresponding fumarates and maleates.

In addition, the monomer mixtures to be used in accordance with the invention may contain from 0 to 80% by weight, preferably from 0.5 to 60% by weight, based on the total weight of the ethylenically unsaturated monomers, of one or more ethylenically unsaturated ester compounds of the formula (III)

(III)

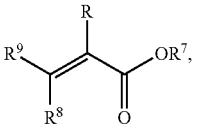

in which R is hydrogen or methyl, $R^7$ is a linear or branched alkyl radical having from 16 to 30 carbon atoms, $R^8$ and $R^9$ are each independently hydrogen or a group of the formula —COOR'" in which R'" is hydrogen or an alkyl group having from 16 to 30 carbon atoms.

Examples of component c) include (meth)acrylates which derive from saturated alcohols, such as hexadecyl (meth) acrylate, 2-methylhexadecyl(meth)acrylate, heptadecyl (meth)acrylate, 5-isopropylheptadecyl (meth)acrylate, 4-tert-butyloctadecyl(meth)acrylate, 5-ethyloctadecyl(meth) acrylate, 3-isopropyloctadecyl (meth)acrylate, octadecyl (meth)acrylate, nonadecyl (meth)acrylate, eicosyl(meth) acrylate, cetyleicosy (meth)acrylate, stearyleicosy (meth) acrylate, docosyl (meth)acrylate and/or eicosyltetratriacontyl (meth)acrylate;

cycloalkyl(meth)acrylates such as 2,4,5-tri-t-butyl-3-vinylcyclohexyl(meth)acrylate, 2,3,4,5-tetra-t-butylcyclohexyl (meth)acrylate;

oxiranyl methacrylates such as 10,11-epoxyhexadecyl methacrylate; and also the corresponding fumarates and maleates.

The ester compounds with a long-chain alcohol radical, especially components (b) and (c), can be obtained, for example, by reacting (meth)acrylates, fumarates, maleates and/or the corresponding acids with long-chain fatty alcohols, which generally forms a mixture of esters, for example (meth)acrylates with different long-chain alcohol radicals. These fatty alcohols include Oxo Alcohol® 7911 and Oxo Alcohol® 7900, Oxo Alcohol® 1100; Alfol® 610, Alfol® 810, Lial® 125 and Nafol® types (Sasol Olefins & Surfactant GmbH); Alphanol® 79 (ICI); Epal® 610 and Epal® 810 (Ethyl Corporation); Linevol® 79, Linevol® 911 and Neodol® 25E (Shell AG); Dehydad®, Hydrenol® and Lorol® types (Cognis); Acropol® 35 and Exxal® 10 (Exxon Chemicals GmbH); Kalcol® 2465 (Kao Chemicals).

As an obligatory constituent, the compositions to be polymerized contain from 0.1 to 30% by weight, in particular from 0.5 to 10% by weight, based on the total weight of the ethylenically unsaturated monomers, of one or more ethylenically unsaturated ester compounds of the formula (IV)

(IV)

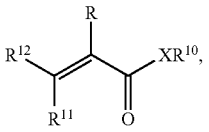

in which R is hydrogen or methyl, X is oxygen, sulfur or an amino group of the formula —NH— or —$NR^a$— in which $R^a$ is an alkyl radical having from 1 to 40 carbon atoms, $R^{10}$ is a radical which comprises from 2 to 1000 carbon atoms and has at least 2 heteroatoms, $R^{11}$ and $R^{12}$ are each independently hydrogen or a group of the formula —COX'$R^{10'}$ in which X' is oxygen or an amino group of the formula —NH— or —$NR^{a'}$— in which $R^{a'}$ is an alkyl radical having from 1 to 40 carbon atoms, and $R^{10'}$ is a radical comprising from 1 to 100 carbon atoms, In formula (IV), X is oxygen, sulfur or an amino group of the formula —NH— or —$NR^a$— in which $R^a$ is an alkyl radical having from 1 to 40, preferably from 1 to 4 carbon atoms.

The $R^{11}$ and $R^{12}$ radicals in formula (IV) are each independently hydrogen or a group of the formula —COX'$R^{10}$ in which X' is oxygen, sulfur or an amino group of the formula —NH— or —$NR^{a'}$— in which $R^{a'}$ is an alkyl radical having from 1 to 40 carbon atoms, preferably from 1 to 4 carbon atoms, and $R^{10'}$ is a radical comprising from 1 to 100, preferably from 1 to 30 and more preferably from 1 to 15 carbon atoms. The expression "radical comprising from 1 to 100 carbon" indicates radicals of organic compounds having from 1 to 100 carbon atoms. It encompasses aromatic and heteroaromatic groups, and also alkyl, cycloalkyl, alkoxy, cycloalkoxy, alkenyl, alkanoyl, alkoxycarbonyl groups and heteroaliphatic groups. The groups mentioned may be branched or unbranched.

The $R^{10}$ radical is a radical comprising from 2 to 1000, in particular from 2 to 100, preferably from 2 to 20 carbon atoms. The expression "radical comprising from 2 to 1000 carbon" indicates radicals of organic compounds having from 2 to 1000 carbon atoms. It includes aromatic and heteroaromatic groups, and alkyl, cycloalkyl, alkoxy, cycloalkoxy, alkenyl, alkanoyl, alkoxycarbonyl groups, and also heteroaliphatic groups. The groups mentioned may be branched or unbranched. In addition, these groups may have customary substituents. Substituents are, for example, linear and branched alkyl groups having from 1 to 6 carbon atoms, for example methyl, ethyl, propyl, butyl, pentyl, 2-methylbutyl or hexyl; cycloalkyl groups, for example cyclopentyl and cyclohexyl; aromatic groups such as phenyl or naphthyl; amino groups, ether groups, ester groups and halides.

According to the invention, aromatic groups denote radicals of mono- or polycyclic aromatic compounds having preferably from 6 to 20, in particular from 6 to 12, carbon atoms. Heteroaromatic groups denote aryl radicals in which at least one CH group has been replaced by N and/or at least two adjacent CH groups have been replaced by S, NH or O, heteroaromatic groups having from 3 to 19 carbon atoms.

Aromatic or heteroaromatic groups preferred in accordance with the invention derive from benzene, naphthalene, biphenyl, diphenyl ether, diphenylmethane, diphenyldimethylmethane, bisphenone, diphenyl sulfone, thiophene, furan, pyrrole, thiazole, oxazole, imidazole, isothiazole, isoxazole, pyrazole, 1,3,4-oxadiazole, 2,5-diphenyl-1,3,4-oxadiazole, 1,3,4-thiadiazole, 1,3,4-triazole, 2,5-diphenyl-1,3,4-triazole, 1,2,5-triphenyl-1,3,4-triazole, 1,2,4-oxadiazole, 1,2,4-thiadiazole, 1,2,4-triazole, 1,2,3-triazole, 1,2,3,4-tetrazole, benzo[b]thiophene, benzo[b]furan, indole, benzo[c]thiophene, benzo[c]furan, isoindole, benzoxazole, benzothiazole, benzimidazole, benzisoxazole, benzisothiazole, benzopyrazole, benzothiadiazole, benzotriazole, dibenzofuran, dibenzothiophene, carbazole, pyridine, bipyridine, pyrazine, pyrazole, pyrimidine, pyridazine, 1,3,5-triazine, 1,2,4-triazine, 1,2,4,5-triazine, tetrazine, quinoline, isoquinoline, quinoxaline, quinazoline, cinnoline, 1,8-naphthyridine, 1,5-naphthyridine, 1,6-naphthyridine, 1,7-naphthyridine, phthalazine, pyridopyrimidine, purine, pteridine or quinolizine, 4H-quinolizine, diphenyl ether, anthracene, benzopyrrole, benzooxathiadiazole, benzooxadiazole, benzopyridine, benzopyrazine, benzopyrazidine, benzopyrimidine, benzotriazine, indolizine, pyridopyridine, imidazopyrimidine, pyrazinopyrimidine, carbazole, aciridine, phenazine, benzoquinoline, phenoxazine, phenothiazine, acridizine, benzopteridine, phenanthroline and phenanthrene, each of which may also optionally be substituted.

The preferred alkyl groups include the methyl, ethyl, propyl, isopropyl, 1-butyl, 2-butyl, 2-methylpropyl, tert-butyl radical, pentyl, 2-methylbutyl, 1,1-dimethylpropyl, hexyl, heptyl, octyl, 1,1,3,3-tetramethylbutyl, nonyl, 1-decyl, 2-decyl, undecyl, dodecyl, pentadecyl and the eicosyl group.

The preferred cycloalkyl groups include the cyclopropyl, cyclobutyl, cyclopentyl, cyclohexyl, cycloheptyl and the cyclooctyl group, each of which is optionally substituted with branched or unbranched alkyl groups.

The preferred alkenyl groups include the vinyl, allyl, 2-methyl-2-propenyl, 2-butenyl, 2-pentenyl, 2-decenyl and the 2-eicosenyl group.

The preferred alkynyl groups include the ethynyl, propargyl, 2-methyl-2-propynyl, 2-butynyl, 2-pentynyl and the 2-decynyl group.

The preferred alkanoyl groups include the formyl, acetyl, propionyl, 2-methylpropionyl, butyryl, valeroyl, pivaloyl, hexanoyl, decanoyl and the dodecanoyl group.

The preferred alkoxycarbonyl groups include the methoxycarbonyl, ethoxycarbonyl, propoxycarbonyl, butoxycarbonyl, tert-butoxycarbonyl, hexyloxycarbonyl, 2-methylhexyloxycarbonyl, decyloxycarbonyl or dodecyloxycarbonyl group.

The preferred alkoxy groups include alkoxy groups whose hydrocarbon radical is one of the aforementioned preferred alkyl groups.

The preferred cycloalkoxy groups include cycloalkoxy groups whose hydrocarbon radical is one of the aforementioned preferred cycloalkyl groups.

The preferred heteroatoms which are present in the $R^{10}$ radical include oxygen, nitrogen, sulfur, boron, silicon and phosphorus, preference being given to oxygen and nitrogen.

The $R^{10}$ radical comprises at least two, preferably at least three, heteroatoms.

The $R^{10}$ radical in ester compounds of the formula (IV) preferably has at least 2 different heteroatoms. In this case, the $R^{10}$ radical in at least one of the ester compounds of the formula (IV) may comprise at least one nitrogen atom and at least one oxygen atom.

In a particular aspect of the present invention, at least one heteroatom in the $R^{10}$ radical in at least one of the ester compounds of the formula (IV) may be separated form the X group by at least 4 atoms, more preferably by at least 6 atoms.

The $R^{10}$ radical in at least one of the ester compounds of the formula (IV) is preferably a group of the formula (V)

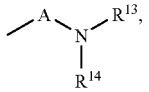

(V)

in which A is a connecting group having from 1 to 50.0 carbon atoms, preferably from 1 to 100 carbon atoms and more preferably from 1 to 50 carbon atoms, and the $R^{13}$ and $R^{14}$ radicals are each independently hydrogen or an alkyl group having from 1 to 40 carbon atoms, more preferably from 1 to 20 carbon atoms and most preferably from 1 to 4 carbon atoms. The expression "connecting group having from 1 to 500 carbon atoms" indicates radicals of organic compounds which comprise from 1 to 500 carbon atoms. It encompasses aromatic and heteroaromatic groups, and also alkyl, cycloalkyl, alkoxy, cycloalkoxy, alkenyl, alkanoyl, alkoxycarbonyl groups and heteroaliphatic groups. These radicals have been explained in detail above.

The preferred connecting groups in formula (V) include groups of the formula (VI)

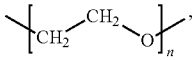

(VI)

in which n is an integer in the range from 1 to 8, preferably from 1 to 6 and more preferably from 1 to 3.

The $R^{10}$ radical in at least one ester compound of the formula (IV) is preferably a group of the formula (VII)

(VII)

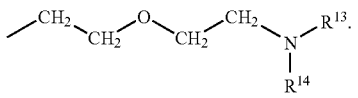

More preferably, component d) comprises dimethylaminodiglycol methacrylate (2-[2-(dimethylamino)ethoxy]ethyl methacrylate; 2-[2-(dimethylamino)ethoxy]ethyl 2-methyl-2-propenoate) of the formula (VIII)

(VIII)

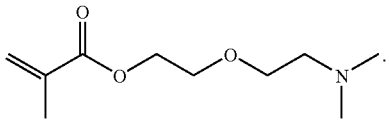

In a further aspect of the present invention, the $R^{10}$ radical in at least one of the ester compounds of the formula (IV) may comprise at least one group, more preferably at least two groups, of the formula —CO—. The groups of the formula —CO— may be carbonyl groups of ketones and/or aldehydes, carbonyl groups of carboxylic acids, carboxylic esters and/or carboxamides, and/or carbonyl groups of carbonic acid derivatives, especially of urea groups and/or urethane groups.

In this case, at least two groups of the formula —CO— may be bonded to one another via at most 4 atoms.

The $R^{10}$ radical in at least one ester compound of the formula (IV) may preferably be a group of the formula (IX)

(IX)

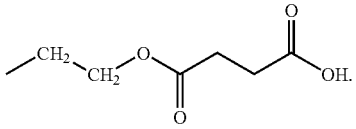

More preferably, component d) comprises mono-2-methacryloyloxyethyl succinate of the formula (X)

(X)

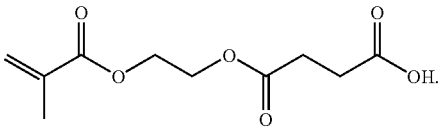

The $R^{10}$ radical in at least one ester compound of the formula (IV) may preferably be a group of the formula (XI)

(XI)

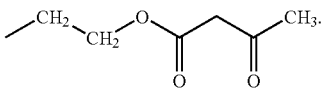

More preferably, component d) comprises 2-acetoacetoxyethyl methacrylate (2-[(2-methyl-1-oxo-2-propenyl)oxy]ethyl 3-oxobutanoate) of the formula (XII)

(XII)

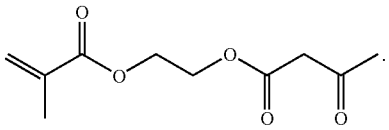

In a further aspect of the present invention, the $R^{10}$ radical in at least one of the ester compounds of the formula (IV) may comprise at least one group of the formula —CO— and at least one nitrogen atom.

In this case, the $R^{10}$ radical in at least one of the ester compounds of the formula (IV) may have at least one urea group, urea groups generally being representable by the formula —$NR^b$—CO—$NR^c$— in which the $R^b$ and $R^c$ radicals are each independently hydrogen or a group having from 1 to 40 carbon atoms, preferably from 1 to 20 carbon atoms and more preferably from 1 to 4 carbon atoms, or the radicals $R^b$ and $R^c$ radicals may form a ring having from 1 to 80 carbon atoms.

The $R^{10}$ radical in at least one ester compound of the formula (IV) may preferably be a group of the formula (XIII)

(XIII)

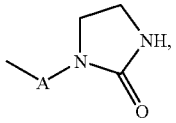

in which A is a connecting group having from 1 to 500 carbon atoms, preferably from 1 to 100 carbon atoms and more preferably from 1 to 50 carbon atoms. The expression "connecting group having from 1 to 500 carbon atoms" has already been explained in detail above.

More preferably, component d) comprises N-(2-methacryloyloxyethyl)ethyleneurea (2-(2-oxo-1-imidazolidinyl)ethyl 2-methyl-2-propenoate) of the formula (XIV)

(XIV)

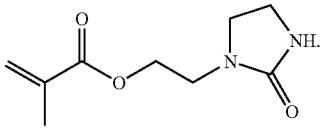

Among the ethylenically unsaturated ester compounds, particular preference is given to the (meth)acrylates over the maleates and fumarates, i.e. $R^2$, $R^3$, $R^5$, $R^6$, $R^8$, $R^9$, $R^{11}$ and $R^{12}$ of the formulae (I), (II), (III) and (IV) are, in preferred embodiments, more preferably hydrogen.

Monomers in component d) may, similarly to the monomers in components b) or c), be obtained by transesterifying methyl(meth)acrylates with appropriate alcohols, amines and/or thiols. In addition, some of these monomers are commercially available.

Component e) comprises in particular ethylenically unsaturated monomers which can be copolymerized with the ethylenically unsaturated ester compounds of the formulae (I), (II), (III) and/or (IV).

However, particularly suitable comonomers for polymerization according to the present invention are those which correspond to the formula:

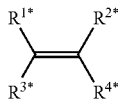

in which $R^{1*}$ and $R^{2*}$ are each independently selected from the group consisting of hydrogen, halogens, CN, linear or branched alkyl groups having from 1 to 20, preferably from 1 to 6 and more preferably from 1 to 4, carbon atoms which may be substituted by from 1 to (2n+1) halogen atoms, where n is the number of carbon atoms of the alkyl group (for example $CF_3$), α,β-unsaturated linear or branched alkenyl or alkynyl groups having from 2 to 10, preferably from 2 to 6 and more preferably from 2 to 4, carbon atoms which may be substituted by from 1 to (2n−1) halogen atoms, preferably chlorine, where n is the number of carbon atoms of the alkyl group, for example $CH_2{=}CCl{-}$, cycloalkyl groups having from 3 to 8 carbon atoms which may be substituted by from 1 to (2n−1) halogen atoms, preferably chlorine, where n is the number of carbon atoms of the cycloalkyl group; $C({=}Y^*)R^{5*}$, $C({=}Y^*)NR^{6*}R^{7*}$, $Y^*C({=}Y^*)R^{5*}$, $SOR^{5*}$, $SO_2R^{5*}$, $OSO_2R^{5*}$, $NR^{8*}SO_2R^{5*}$, $PR^{5*}_2$, $P({=}Y^*)R^{5*}_2$, $Y^*PR^{5*}_2$, $Y^*P({=}Y^*)R^{5*}_2$, $NR^{8*}_2$ which may be quaternized with an additional $R^{8*}$, aryl or heterocyclyl group, where $Y^*$ may be $NR^{8*}$, S or O, preferably O; $R^5$ is an alkyl group having from 1 to 20 carbon atoms, an alkylthio having from 1 to 20 carbon atoms, $OR^{15}$ ($R^{15}$ is hydrogen or an alkali metal), alkoxy of from 1 to 20 carbon atoms, aryloxy or heterocyclyloxy; $R^{6*}$ and $R^{7*}$ are each independently hydrogen or an alkyl group having from 1 to 20 carbon atoms, or $R^{6*}$ and $R^{7*}$ together may form an alkylene group having from 2 to 7, preferably from 2 to 5 carbon atoms, in which case they form a 3- to 8-membered, preferably 3- to 6-membered, ring, and $R^{8*}$ is hydrogen, linear or branched alkyl or aryl groups having from 1 to 20 carbon atoms;

$R^{3*}$ and $R^{4*}$ are independently selected from the group consisting of hydrogen, halogen (preferably fluorine or chlorine), alkyl groups having from 1 to 6 carbon atoms and $COOR^{9*}$ in which $R^{9*}$ is hydrogen, an alkali metal or an alkyl group having from 1 to 40 carbon atoms, or $R^{1*}$ and $R^{3*}$ together may form a group of the formula $(CH_2)_{n'}$ which may be substituted by from 1 to 2n' halogen atoms or $C_1$ to $C_4$ alkyl groups, or form the formula $C({=}O){-}Y^*{-}C({=}O)$ where n' is from 2 to 6, preferably 3 or 4, and $Y^*$ is as defined above; and where at least 2 of the $R^{1*}$, $R^{2*}$, $R^{3*}$ and $R^{4*}$ radicals are hydrogen or halogen.

These include hydroxyalkyl(meth)acrylates such as 3-hydroxypropyl methacrylate, 3,4-dihydroxybutyl methacrylate, 2-hydroxyethyl methacrylate, 2-hydroxypropyl methacrylate, 2,5-dimethyl-1,6-hexanediol (meth)acrylate, 1,10-decanediol (meth)acrylate, aminoalkyl(meth)acrylates such as N-(3-dimethylaminopropyl)methacrylamide, 3-diethylaminopentyl methacrylate, 3-dibutylaminohexadecyl (meth)acrylate;

nitriles of (meth)acrylic acid and other nitrogen-containing methacrylates, such as N-(methacryloyloxyethyl)diisobutyl ketimine, N-(methacryloyloxyethyl)dihexadecyl ketimine, methacryloylamidoacetonitrile, 2-methacryloyloxyethylmethylcyanamide, cyanomethyl methacrylate;

aryl(meth)acrylates such as benzyl methacrylate or phenyl methacrylate in which the aryl radicals may each be unsubstituted or up to tetrasubstituted;

vinyl halides, for example vinyl chloride, vinyl fluoride, vinylidene chloride and vinylidene fluoride;

vinyl esters such as vinyl acetate;

styrene, substituted styrenes having an alkyl substituent in the side chain, for example α-methylstyrene and α-ethylstyrene, substituted styrenes having an alkyl substituent on the ring, such as vinyltoluene and p-methylstyrene, halogenated styrenes, for example monochlorostyrenes, dichlorostyrenes, tribromostyrenes and tetrabromostyrenes;

heterocyclic vinyl compounds such as 2-vinylpyridine, 3-vinylpyridine, 2-methyl-5-vinylpyridine, 3-ethyl-4-vinylpyridine, 2,3-dimethyl-5-vinylpyridine, vinylpyrimidine, vinylpiperidine, 9-vinylcarbazole, 3-vinylcarbazole, 4-vinylcarbazole, 1-vinylimidazole, 2-methyl-1-vinylimidazole, N-vinylpyrrolidone, 2-vinylpyrrolidone, N-vinylpyrrolidine, 3-vinylpyrrolidine, N-vinylcaprolactam, N-vinylbutyrolactam, vinyloxolane, vinylfuran, vinylthiophene, vinylthiolane, vinylthiazoles and hydrogenated vinylthiazoles, vinyloxazoles and hydrogenated vinyloxazoles;

vinyl and isoprenyl ethers;

maleic acid and maleic acid derivatives, for example mono- and diesters of maleic acid, maleic anhydride, methylmaleic anhydride, maleimide, methylmaleimide;

fumaric acid and fumaric acid derivatives, for example mono- and diesters of fumaric acid;

dienes, for example divinylbenzene.

These components may be used individually or as mixtures. However, it is a prerequisite that at least two different monomers are polymerized.

Preferred copolymers have a specific viscosity $\eta_{sp/c}$, measured in chloroform at 25° C., in the range from 8 to 74 ml/g, more preferably in the range from 11 to 55 ml/g, measured to ISO 1628-6.

The inventive copolymers may generally have a molecular weight in the range from 1000 to 1 000 000 g/mol, preferably in the range from $10\times10^3$ to $500\times10^3$ g/mol and more preferably in the range from $20\times10^3$ to $300\times10^3$ g/mol, without any intention that this should impose a restriction. The values are based on the weight-average molecular weight of the polydisperse polymers in the composition. This parameter can be determined by GPC.

The preferred copolymers which can be obtained by polymerizing unsaturated ester compounds preferably have a polydispersity $M_w/M_n$ in the range from 1.05 to 4.0. This parameter can be determined by GPC.

The preparation of the polyalkyl esters from the above-described compositions is known per se. For instance, these polymers can be effected especially by free-radical polymerization, and also related processes, for example ATRP (=atom transfer radical polymerization) or RAFT (=reversible addition fragmentation chain transfer).

The customary free-radical polymerization is explained, inter alia, in Ullmanns's Encyclopedia of Industrial Chemistry, Sixth Edition. In general, a polymerization initiator and a chain transferrer are used for this purpose.

The usable initiators include the azo initiators well known in the technical field, such as AIBN and 1,1-azo-biscyclohexanecarbonitrile, and also peroxy compounds such as methyl ethyl ketone peroxide, acetylacetone peroxide, dilauryl peroxide, tert-butyl per-2-ethylhexanoate (often also referred to as tert-butyl peroctoate tBPO), ketone peroxide, tert-butyl peroctoate, methyl isobutyl ketone peroxide, cyclohexanone peroxide, dibenzoyl peroxide, tert-butyl peroxybenzoate, tert-butyl peroxyisopropylcarbonate, 2,5-bis(2-ethylhexanoylperoxy)-2,5-dimethylhexane, tert-butyl peroxy-2-ethylhexanoate, tert-butyl peroxy-3,5,5-trimethylhexanoate, dicumyl peroxide, 1,1-bis(tert-butylperoxy)cyclohexane, 1,1-bis(tert-butylperoxy)-3,3,5-trimethylcyclohexane, cumyl hydroperoxide, tert-butyl hydroperoxide, bis(4-tert-butylcyclohexyl) peroxydicarbonate, mixtures of two or more of the aforementioned compounds with one another, and also mixtures of the aforementioned compounds with compounds which have not been mentioned and can likewise form free radicals. Suitable chain transferers are especially oil-soluble mercaptans, for example tert-dodecyl mercaptan or 2-mercaptoethanol, or else chain transferers from the class of the terpenes, for example terpinolene.

The ATRP process is known per se. It is assumed that this is a "living" free-radical polymerization, without any intention that this should restrict the description of the mechanism. In these processes, a transition metal compound is reacted with a compound which has a transferable atom group. This transfers the transferable atom group to the transition metal compound, which oxidizes the metal. This reaction forms a radical which adds onto ethylenic groups. However, the transfer of the atom group to the transition metal compound is reversible, so that the atom group is transferred back to the growing polymer chain, which forms a controlled polymerization system. The structure of the polymer, the molecular weight and the molecular weight distribution can be controlled correspondingly.

This reaction is described, for example, by J-S. Wang, et al., J. Am. Chem. Soc., vol. 117, p. 5614-5615 (1995), by Matyjaszewski, Macromolecules, vol. 28, p. 7901-7910 (1995). In addition, the patent applications WO 96/30421, WO 97/47661, WO 97/18247, WO 98/40415 and WO 99/10387, disclose variants of the ATRP explained above.

In addition, the inventive polymers may be obtained, for example, also via RAFT methods. This process is presented in detail, for example, in WO 98/01478 and WO 2004/083169, to which reference is made explicitly for the purposes of disclosure.

The polymerization may be carried out at standard pressure, reduced pressure or elevated pressure. The polymerization temperature too is uncritical. However, it is generally in the range of −20°-200° C., preferably 0°-130° C. and more preferably 60°-120° C.

The polymerization may be carried out with or without solvent. The term solvent is to be understood here in a broad sense.

The polymerization is preferably carried out in a nonpolar solvent. These include hydrocarbon solvents, for example aromatic solvents such as toluene, benzene and xylene, saturated hydrocarbons, for example cyclohexane, heptane, octane, nonane, decane, dodecane, which may also be present in branched form. These solvents may be used individually and as a mixture. Particularly preferred solvents are mineral oils, natural oils and synthetic oils, and also mixtures thereof. Among these, very particular preference is given to mineral oils.

The structure of the inventive copolymers is not critical for many applications and properties. Accordingly, the inventive copolymers may be random copolymers.

In a particular aspect of the present invention inventive copolymers may have a gradient. In this case, the monomer composition can change during the chain growth in order to obtain copolymers which have a gradient.

In a further aspect of the present invention, the inventive copolymers may be block copolymers. These polymers can be obtained, for example, by changing the monomer composition discontinuously during the chain growth. The blocks derived from ester compounds of the formulae (I), (II) and/or (III) preferably have at least 30 monomer units.

Block copolymers denote polymers which have at least two blocks. Blocks in this context are segments of the copolymer which have a constant composition composed of one or more monomer units. The individual blocks may be formed from different monomers. In addition, the blocks may differ only by the concentration of different monomer units, in which case a random distribution of the different monomer units may be present within one block.

In an interesting aspect of the present invention, the different blocks feature a concentration difference of at least one monomer unit of 5% or more, preferably at least 10% and more preferably at least 20%, without any intention that this should impose a restriction.

The term "concentration of the monomer units" relates to the number of these units which are derived from the monomers used, based on the total number of repeating units within a block. The concentration difference arises from the difference between the concentration of at least one monomer unit of two blocks.

The person skilled in the art is aware of the polydispersity of polymers. Accordingly, the data regarding the concentration difference are based on a static average over all polymer chains of the corresponding segments.

The length of the blocks may vary within wide ranges. According to the invention, the blocks may have preferably at least 30, more preferably at least 50, particularly preferably at least 100 and most preferably at least 150 monomer units.

As well as diblock copolymers, the present invention also provides multiblock copolymers which have at least three, preferably at least four blocks. These block copolymers may have alternating blocks. In addition, the block copolymers may also be present as comb polymers or as star polymers.

Preferred block copolymers may comprise hydrophobic segments which are obtained by polymerizing monomer compositions which comprise especially (meth)acrylates, maleates and/or fumarates. The hydrophobic segments are derived in particular from ethylenically unsaturated compounds of the formulae (I), (II) and/or (III). In addition, these preferred block copolymers comprise polar segments which comprise monomers of the formula (IV).

Particularly preferred block copolymers comprise at least one hydrophobic segment P and at least one polar segment D, the hydrophobic segment being obtainable by polymerizing monomer compositions which comprise a) from 0 to 40% by weight, in particular from 0.5 to 20% by weight, based on the weight of the monomer compositions for preparing the hydrophobic segments, of at least one ethylenically unsaturated ester compound of the formula (I)

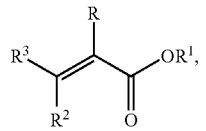

(I)

in which R is hydrogen or methyl, $R^1$ is a linear or branched alkyl radical having from 1 to 5 carbon atoms, $R^2$ and $R^3$ are each independently hydrogen or a group of the formula —COOR' in which R' is hydrogen or an alkyl group having from 1 to 5 carbon atoms, b) from 10 to 99.9% by weight, in particular from 55 to 95% by weight, based on the weight of the monomer compositions for preparing the hydrophobic segments, of at least one ethylenically unsaturated ester compound of the formula (II)

(II)

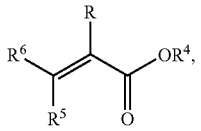

in which R is hydrogen or methyl, $R^4$ is a linear or branched alkyl radical having from 6 to 15 carbon atoms, $R^5$ and $R^6$ are each independently hydrogen or a group of the formula —COOR" in which R" is hydrogen or an alkyl group having from 6 to 15 carbon atoms, c) from 0 to 80% by weight, in particular from 0.5 to 60% by weight, based on the weight of the monomer compositions for preparing the hydrophobic segments, of at least one ethylenically unsaturated ester compound of the formula (III)

(III)

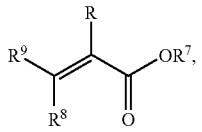

in which R is hydrogen or methyl, $R^7$ is a linear or branched alkyl radical having from 16 to 30 carbon atoms, $R^8$ and $R^9$ are each independently hydrogen or a group of the formula —COOR'" in which R'" is hydrogen or an alkyl group having from 16 to 30 carbon atoms, e) from 0 to 50% by weight, based on the weight of the monomer compositions for preparing the hydrophobic segments, of comonomer, and the polar segment comprising units derived from ethylenically unsaturated, polar ester compounds of the formula (IV)

(IV)

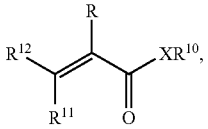

in which R is hydrogen or methyl, X is oxygen, sulfur or an amino group of the formula —NH— or —$NR^a$— in which $R^a$ is an alkyl radical having from 1 to 40 carbon atoms, $R^{10}$ is a radical which comprises from 2 to 1000 carbon atoms and has at least 2 heteroatoms, $R^{11}$ and $R^{12}$ are each independently hydrogen or a group of the formula —COX'$R^{10'}$ in which X' is oxygen or an amino group of the formula —NH— or —$NR^{a'}$— in which $R^{a'}$ is an alkyl radical having from 1 to 40 carbon atoms, and $R^{10'}$ is a radical comprising from 1 to 100 carbon atoms, wherein at least one polar segment comprises at least 3 units which are derived from monomers of the formula (IV) and are bonded directly to one another.

The polar segments preferably have a high proportion of polar units which are derived from monomers of the formula (IV). At least one polar segment preferably comprises at least 50% by weight, more preferably at least 70% by weight and more preferably at least 80% by weight, based on the weight of the polar segment, of units derived from monomers of the formula (IV).

Accordingly, preferred block copolymers having hydrophobic segments P and polar segments D can be represented by the formula $$P_m\text{-}D_n \qquad \text{(XV)}$$

in which m and n are each independently integers in the range from 1 to 40, especially from 1 to 5 and preferably 1 or 2, without any intention that this should impose a restriction. m=1 and n=5 may, for example, give rise to a comb polymer or a star polymer. m=2 and n=2 may, for example, give rise to a star polymer or a block copolymer with alternating P-D-P-D blocks.

The length of the hydrophobic and polar segments may vary within wide ranges. The hydrophobic segments P preferably have a weight-average degree of polymerization of at least 10, in particular at least 50. The weight-average degree of polymerization of the hydrophobic segments is preferably in the range from 20 to 5000, in particular from 60 to 2000.

The length of the polar segments D may preferably be at least 3, more preferably at least 5 and particularly preferably at least 10 monomer units, these monomer units preferably being derived from compounds of the formula (IV).

The polar segments D preferably have a weight-average degree of polymerization in the range from 10 to 1000.

In a particular aspect, the weight ratio of the polar segments D to the hydrophobic segments P is in the range from 1:1 to 1:100, preferably from 1:2 to 1:30.

In a preferred embodiment of the present invention, the lengths of the hydrophobic segments relative to the polar segments of the copolymer exhibit a ratio in the range from 10:1 to 1:10, preferably from 5:1 to 1:2 and more preferably from 3:1 to 1:1, although other length ratios of the blocks relative to one another shall also be encompassed by the present invention.

The person skilled in the art is aware of the polydispersity of the block copolymers and of the individual segments. The values reported are based on the weight-average of the particular molecular weight.

The inventive copolymer may preferably be used in a lubricant oil composition. A lubricant oil composition comprises at least one lubricant oil.

The lubricant oils include especially mineral oils, synthetic oils and natural oils.

Mineral oils are known per se and commercially available. They are generally obtained from mineral oil or crude oil by distillation and/or refining and optionally further purification and finishing processes, the term mineral oil including in particular the higher-boiling fractions of crude or mineral oil. In general, the boiling point of mineral oil is higher than 200° C., preferably higher than 300° C., at 5000 Pa. The production by low-temperature carbonization of shale oil, coking of bituminous coal, distillation of brown coal with exclusion of air, and also hydrogenation of bituminous or brown coal is likewise possible. Mineral oils are also produced in a smaller proportion from raw materials of vegetable (for example from jojoba, rapeseed) or animal (for example neatsfoot oil) origin. Accordingly, mineral oils have, depending on their origin, different proportions of aromatic, cyclic, branched and linear hydrocarbons.

In general, a distinction is drawn between paraffin-base, naphthenic and aromatic fractions in crude oils or mineral oils, in which the term paraffin-base fraction represents longer-chain or highly branched isoalkanes, and naphthenic fraction represents cycloalkanes. In addition, mineral oils, depending on their origin and finishing, have different fractions of n-alkanes, isoalkanes having a low degree of branching, known as mono-methyl-branched paraffins, and compounds having heteroatoms, in particular O, N and/or S, to which, a degree of polar properties are attributed. However, the assignment is difficult, since individual alkane molecules may have both long-chain branched groups and cycloalkane radicals, and aromatic parts. For the purposes of the present invention, the assignment can be effected to DIN 51 378, for example. Polar fractions can also be determined to ASTM D 2007.

The fraction of n-alkanes in preferred mineral oils is less than 3% by weight, the proportion of O-, N- and/or S-containing compounds less than 6% by weight. The proportion of the aromatics and of the mono-methyl-branched paraffins is generally in each case in the range from 0 to 40% by weight. In one interesting aspect, mineral oil comprises mainly naphthenic and paraffin-base alkanes which have generally more than 13, preferably more than 18 and most preferably more than 20 carbon atoms. The fraction of these compounds is generally ≧60% by weight, preferably ≧80% by weight, without any intention that this should impose a restriction. A preferred mineral oil contains from 0.5 to 30% by weight of aromatic fractions, from 15 to 40% by weight of naphthenic fractions, from 35 to 80% by weight of paraffin-base fractions, up to 3% by weight of n-alkanes and from 0.05 to 5% by weight of polar compounds, based in each case on the total weight of the mineral oil.

An analysis of particularly preferred mineral oils, which was effected by means of conventional processes such as urea separation and liquid chromatography on silica gel, shows, for example, the following constituents, the percentages relating to the total weight of the particular mineral oil used:

n-alkanes having from approx. 18 to 31 carbon atoms:
0.7-1.0%,
slightly branched alkanes having from 18 to 31 carbon atoms:
1.0-8.0%,
aromatics having from 14 to 32 carbon atoms:
0.4-10.7%,
iso- and cycloalkanes having from 20 to 32 carbon atoms:
60.7-82.4%,
polar compounds:
0.1-0.8%,
loss:
6.9-19.4%.

Valuable information with regard to the analysis of mineral oils and a list of mineral oils which have a different composition can be found, for example, in Ullmann's Encyclopedia of Industrial Chemistry, 5th Edition on CD-ROM, 1997, under "lubricants and related products".

Synthetic oils include organic esters, for example diesters and polyesters, polyalkylene glycols, polyethers, synthetic hydrocarbons, especially polyolefins, among which preference is given to polyalphaolefins (PAO), silicone oils and perfluoroalkyl ethers. They are usually somewhat more expensive than the mineral oils, but have advantages with regard to their performance.

Natural oils are animal or vegetable oils, for example neatsfoot oils or jojoba oils.

These lubricant oils may also be used as mixtures and are in many cases commercially available.

The concentration of the polyalkyl ester in the lubricant oil composition is preferably in the range from 2 to 40% by weight, more preferably in the range from 4 to 20% by weight, based on the total weight of the composition.

In addition to the aforementioned components, a lubricant oil composition may comprise further additives.

These additives include antioxidants, corrosion inhibitors, antifoams, antiwear components, dyes, dye stabilizers, detergents, pour point depressants and/or DI additives.

Preferred lubricant oil compositions have a viscosity, measured at 40° C. to ASTM D 445, in the range from 10 to 120 $mm^2/s$, more preferably in the range from 22 to 100 $mm^2/s$.

In a particular aspect of the present invention, preferred lubricant oil compositions have a viscosity index, measured to ASTM D 2270, in the range from 120 to 350, especially from 140 to 200.

The inventive copolymers exhibit outstanding dispersing action. This property can be measured, for example, to CEC L-48-A-00 ("oxidation stability of lubricating oils used in automotive transmissions by artificial ageing"). In this test, the degree of oxidation is detected by the viscosity rise. The lower ΔKV100 or ΔKV40 is, the better the oxidation stability and the dispersibility of the polymer. In addition, the values for the heptane-insoluble mass fractions can be utilized in order to describe oxidation stability and dispersibility.

Furthermore, the dispersing action of the copolymers can be determined to JIS K2514. In this test, the pentane-insoluble constituents are measured, and the outstanding properties of the copolymers can be measured either to JIS K2514 method A (without addition of flocculants) or to JIS K2514 method B (after addition of flocculants).

In addition, the dispersancy can be determined on the oxidized oil by determining the soil-bearing capacity on blotting paper in the form of the ratio of the run radii of oxidation residue and base oil. These tests are known and widespread in the oil industry as so-called blotter spot tests.

In the aforementioned processes, an oxidation step is typically performed in order to investigate the dispersibility of additives. However, this step can be replaced by adding soot particles in order to investigate the dispersing action without influence of the outstanding antioxidant properties of the present copolymers.

In these methods, commercial soots, for example carbon blacks such as Printex 95 from Degussa AG (Hanau) are added to the formulation in a controlled manner and stirred in vigorously (for example with the aid of a high-speed stirrer or with the aid of steel grinding balls in a shaking machine), and the dispersancy is evaluated in the form of a viscosity rise, of a proportion by mass of undispersed soot or of a run radius ratio (cf. EP 0 699-694) as described above. Equally, instead of soots, it is of course also possible to utilize other types of pigments, for example organic pigments such as the copper phthalocyanine Heliogen blue L7101F from BASF AG (Ludwigshafen) or inorganic pigments such as the titanium dioxide Kronos 2310 from Kronos Titan GmbH (Leverkusen), in order to show dispersing action as required for other applications, for example in the coatings industry.

It is also possible to characterize the interface activity of the dispersing polymers with the aid of a toluene/water test, i.e. their ability to stabilize water-in-oil emulsions or generally the ability to disperse polar substances in nonpolar organic medium. This test therefore serves as a model of the dispersion of polar sludges in motor oil. The slower the emulsion separates, the higher the interface activity and dispersing action. This method is described in detail in EP 0 699 694.

In addition, lubricant oil compositions which comprise copolymers according to the present invention have a particularly high oxidation resistance. The oxidation resistance can be determined by changes in the acid number or in the carbonyl band in the infrared spectrum.

Furthermore, the copolymers of the present invention can serve as a corrosion protection additive.

The corrosion behavior of lubricant oil compositions can be measured under the ZF 702047 process of ZF Friedrichshafen AG ("Korrosionsverhalten gegenüber Kupfer" [Corrosion behavior toward copper]), which is performed under severe conditions (150° C. for 168 h), this test being performed to a setup according to CEC L-48-A-00 with 5 liters of air supply per minute. A copper rod according to ISO 2160 is introduced into the experimental arrangement and, after the experiment has been performed, the copper content in the oil is determined to DIN 51391-2. This should, for example, be max. 50 mg/kg (CVT oils) or 150 mg/kg (HGV oils), corresponding to a loss of mass of the copper sample of approx. 1.5 mg (CVT oil) or 5 mg (HGV oil). The inventive copolymers enable compliance with this standard with very low addition of additive to the lubricant oil compositions.

In addition, the corrosion behavior can be investigated according to the VW PV 1401 process of Volkswagen AG ("Korrosionsschutz gegenüber Stahl" [Corrosion protection with respect to steel]), which is widespread in the automobile industry and in which the corrosion is effected under relatively mild conditions (40° C. for 48 h). The surface assessment into several categories leads to a classification into degrees of corrosion, values of ≦level 3 being desirable. The inventive copolymers enable compliance with this standard with very low addition of additive to the lubricant oil compositions.

In addition, the inventive copolymers exhibit outstanding action as a metal deactivator.

The metal deactivator property of the inventive copolymers can be determined to ASTM D130 or ISO 2160 ("copper corrosion test"), to ASTM D665 method A ("non-corrosion and non-rusting properties") and to ASTM D1748 ("rust protection test").

The invention will be illustrated in detail hereinafter by examples, without any intention that the invention be restricted to these examples.

EXAMPLE 1

Preparation of Dimethylaminodiglycol Methacrylate

A 2 l four-neck flask with saber stirrer, stirrer motor, contact thermometer, heating mantle, air inlet tube, column with random packing, and vapor divider was initially charged with 491.2 g of dimethylaminodiglycol (=2-(2-dimethylamino (ethoxy))ethanol from BASF AG, Ludwigshafen), 1110.0 g of methyl methacrylate (MMA), 0.37 g of phenothiazine, 0.37 g of N,N-diphenylphenylenediamine and 11 mg of Tempol, and heated to 60° C. with stirring, and 4.80 g of lithium methoxide were added. The methanol (MeOH) which forms was distilled off continuously as a MMA/MeOH azeotrope until a constant temperature of 100° C. was established at the top of the column. Subsequently, 1% Celatorn FW 80 was stirred in as a filtering aid, the reaction mixture was filtered through a SEITZ T1000 depth filter layer and the excess MMA was drawn off at 80° C. on a rotary evaporator at approx. 12 mbar. The residue was distilled once again under reduced pressure for purification.

Preparation of a Dispersing Block Polymer Comprising Dimethylaminodiglycol Methacrylate A 2 l four-neck flask with saber stirrer, stirrer motor, N2 inlet tube, contact thermometer and heating mantle was initially charged with 900.0 g of LIMA (methacrylic ester of the C12-C15 alcohol mixture Lial® 125), 225.0 g of KPE 100N oil and 6.75 g of cumyl dithiobenzoate which were heated to 95° C. with stirring. After inertization by introducing nitrogen and adding dry ice, the polymerization was started by adding 0.90 g of tert-butyl peroxy-2-ethylhexanoate (tBPO). Another 0.90 g of tBPO were added after 2 h and 1.80 g after 4 h. After 6 h of reaction time, the temperature was lowered to 85° C., 89.0 g of dimethylaminodiglycol methacylate and 2.0 g of tBPO were added, and the mixture was stirred at 85° C. overnight. The next day, the mixture was diluted with 434.3 g of KPE 100N oil. This gave a clear, viscous solution.

EXAMPLE 2

Preparation of a dispersing block polymer comprising mono-2-methacryloyloxyethyl succinate A 2 l four-neck flask with saber stirrer, stirrer motor, N2 inlet tube, contact thermometer and heating mantle was initially charged with 1000.0 g of LIMA (methacrylic ester of the C12-C15 alcohol mixture Lial® 125), 250.0 g of butyl acetate and 7.50 g of cumyl dithiobenzoate, and heated to 85° C. with stirring. After inertization by introducing nitrogen and adding dry ice, the polymerization was started by adding 2.0 g of tert-butyl peroxy-2-ethylhexanoate (tBPO). After 2 h, another 2.0 g of tBPO were added. After 6 h of reaction time, the temperature was raised to 90° C., 92.9 g of mono-2-methacryloyloxyethyl succinate (Röhm GmbH & Co KG, Darmstadt) dissolved in 230 g of butyl acetate and 1.0 g of tBPO were added, and the mixture was stirred at 90° C. overnight. The next day, the mixture was diluted with 728.6 g of KPE 100N oil and the butyl acetate was drawn off on a rotary evaporator at 120° C./12 mbar. This gave a clear viscous solution.

EXAMPLE 3

Preparation of a dispersing block polymer comprising N-(2-methacryloyloxyethyl)ethylene urea A 2 l four-neck flask with saber stirrer, stirrer motor, N2 inlet tube, contact thermometer and heating mantle was initially charged with 900.0 g of LIMA (methacrylic ester of the C12-C15 alcohol mixture Lial® 125), 225.0 g of butyl acetate and 6.75 g of cumyl dithiobenzoate, and heated to 90° C. with stirring. After inertization by introducing nitrogen and adding dry ice, the polymerization was started by adding 1.80 g of tert-butyl peroxy-2-ethylhexanoate (tBPO). After 2 h and 4 h, in each case 0.90 g of tBPO was added. After 6 h of reaction time, 78.3 g of N-(2-methacryloyloxyethyl)ethylene urea (obtainable by removing the MMA from a 25% solution of N-(2-methacryloyloxyethyl)ethylene urea in MMA=Plex® 6855-O from Röhm GmbH and Co. KG, Darmstadt) dissolved in 300 g of butyl acetate and 1.0 g of tBPO were added, and the mixture was stirred at 90° C. overnight. The next day, the mixture was diluted with 647.9 g of KPE 100N oil and the butyl acetate was drawn off on a rotary evaporator at 120° C./12 mbar. This gave a clear viscous solution.

EXAMPLE 4

Preparation of a dispersing block polymer comprising 2-acetoacetoxyethyl methacrylate A 2 l four-neck flask with saber stirrer, stirrer motor, N2 inlet tube, contact thermometer and heating mantle was initially charged with 900.0 g of LIMA (methacrylic ester of the C12-C15 alcohol mixture Lial® 125), 225.0 g of butyl acetate and 6.75 g of cumyl dithiobenzoate, and heated to 85° C. with stirring. After inertization by introducing nitrogen and adding dry ice, the polymerization was started by adding 1.80 g of tert-butyl peroxy-2-ethylhexanoate (tBPO). After 2 h, another 0.90 g of tBPO was added. After 6 h of reaction time, 78.3 g of 2-acetoacetoxyethyl methacrylate (Lonzamon AAEMA from Lonza, Switzerland) dissolved in 300 g of butyl acetate and 0.90 g of tBPO were added, and the mixture was stirred at 85° C. overnight. The next day, the mixture was diluted with 652.2 g of KPE 100N oil and the butyl acetate was drawn off on a rotary evaporator at 120° C./12 mbar. This gave a clear viscous solution.

COMPARATIVE EXAMPLE 1

A 2 l four-neck flask with saber stirrer, stirrer motor, N2 inlet tube, contact thermometer and heating mantle was initially charged with 608.0 g of LIMA (methacrylic ester of the C12-C15 alcohol mixture Lial® 125) together with 2.90 g of cumyl dithiobenzoate, 1.22 g of tBPO (tert-butyl peroctoate) and 160 g of mineral oil in the reaction flask, and inertized by adding dry ice and passing nitrogen over. Subsequently, the mixture was heated to 85° C. with stirring.

After a reaction time of approx. 5 hours, 32.0 g of hydroxyethyl methacylate were added. After 2.5 hours, 0.64 g of tBPO was added and the reaction mixture was stirred at 85° C. overnight. This gave a clear viscous solution of the polymer in oil.

COMPARATIVE EXAMPLE 2

A 2 l four-neck flask with saber stirrer, stirrer motor, N2 inlet tube, contact thermometer and heating mantle was initially charged with 608.0 g of LIMA (methacrylic ester of the C12-C15 alcohol mixture Lial® 125) together with 2.90 g of cumyl dithiobenzoate, 1.22 g of tBPO (tert-butyl peroctoate) and 160 g of mineral oil in the reaction flask, and inertized by adding dry ice and passing nitrogen over. Subsequently, the mixture was heated to 85° C. with stirring.

After a reaction time of approx. 5 hours, 32.0 g of dimethylaminoethyl methacrylate were added. After 2.5 hours, 0.64 g of tBPO was added and the reaction mixture was stirred at 85° C. overnight. This gave a clear viscous solution of the polymer in oil.

EXAMPLES 5 TO 8 AND COMPARATIVE EXAMPLES 3 AND 4

The properties of the resulting copolymers were mixed with a base oil. The mixtures were subsequently investigated in a friction experiment.

The friction experiments were performed on a mini-traction machine (PCS Instruments) under the following conditions:

TABLE 4

| Measurement parameters and conditions for the MTM friction tests | |
|---|---|
| Test Rig | PCS MTM 3 |
| Disk | Steel, AISI 52100, diameter = 40.0 mm, RMS = 25-30 nm, Rockwell C hardness = 63, modulus of elasticity = 207 GPa |
| Ball | Steel, AISI 52100, diameter = 19.0 mm, RMS = 10-13 nm, Rockwell C hardness = 58-65, modulus of elasticity = 207 GPa |

TABLE 4-continued

| Measurement parameters and conditions for the MTM friction tests | |
|---|---|
| Test Rig | PCS MTM 3 |
| Speed | 0.005 m/s-2.5 m/s |
| Temperature | 120° C. |
| Friction/roller ratio | 50% |
| Load | 30 N = 0.93 GPa max. Hertzian pressure |

As a result of a friction experiment, a Stribeck curve was obtained, from which the coefficient of friction at 10 mm/s was determined.

| | Copolymer | Coefficient of friction 10 mm/s |
|---|---|---|
| Example 5 | Block copolymer comprising dimethylaminodiglycol methacrylate obtained according to example 1 | 0.024 |
| Example 6 | Block copolymer comprising mono-2-methacryloyloxyethyl succinate obtained according to example 2 | 0.026 |
| Example 7 | Block polymer comprising N-(2-methacryloyloxyethyl) ethylene urea obtained according to example 3 | 0.022 |
| Comparative example 3 | Block copolymer comprising hydroxyethyl methacrylate obtained according to comparative example 1 | 0.033 |
| Comparative example 4 | Block polymer comprising dimethylaminoethyl methacrylate obtained according to comparative example 2 | 0.043 |

COMPARATIVE EXAMPLE 5

A 2 liter four-neck flask equipped with saber stirrer, stirrer motor, $N_2$ inlet tube, contact thermometer, heating mantle and reflux condenser is initially charged with 430 g of 150N oil and 47.8 g of a monomer mixture of C12-C18-alkyl methacrylates and methyl methacrylate in a weight ratio of 99:1. After inertizing by introducing $N_2$ and adding dry ice, the temperature is adjusted to 100° C. Thereafter, 0.71 g of tert-butyl peroctoate is added and, at the same time, a monomer feed—consisting of 522.2 g of a monomer mixture of C12-C18-alkyl methacrylates and methyl methacrylate in a weight ratio of 99:1 and 3.92 g of tert-butyl peroctoate—is started. The feed time is 3.5 h with uniform feed rate. 2 h after the end of feeding, another 1.14 g of tert-butyl peroctoate are added. After heating to 130° C., 13.16 g of 150N oil, 17.45 g of N-vinylpyrrolidone and 1.46 g of tert-butyl perbenzoate are added. In each case 1 h, 2 h and 3 h thereafter, another 0.73 g each time of tert-butyl perbenzoate are added. See also DE 1 520 696 from Röhm & Haas GmbH.

Gel Permeation Chromatography (GPC):

The mass-average molecular weight $M_w$ and the polydispersity index PDI of the polymers were determined by GPC. The measurements were effected in tetrahydrofuran at 35° C. against a polymethyl methacrylate calibration curve from a set of ≧25 standards (Polymer Standards Service or Polymer Laboratories), whose $M_{peak}$ was distributed in a logarithmically uniform manner over the range from $5\cdot10^6$ to $2\cdot10^2$ g/mol. A combination of six columns (Polymer Standards Service SDV 100 Å/2×SDV LXL/2×SDV 100 Å/Shodex KF-800D) was used. To record the signal, an RI detector (Agilent 1100 series) was used.

| | Mw [g/mol] | PDI |
|---|---|---|
| Example 1 (60% polymer content) | 82 700 | 1.3 |
| Example 2 (60% polymer content) | 69 000 | 1.2 |
| Example 3 (60% polymer content) | 76 600 | 1.4 |
| Example 4 (60% polymer content) | 165 000 | 2.2 |
| Comparative example 1 (80% polymer content) | 68 000 | 2.1 |
| Comparative example 2 (80% polymer content) | 72 000 | 2.2 |
| Comparative example 5 (75% polymer content) | 98 000 | 3.4 |

Dispersing Action and Oxidation Stability

Dispersing action and oxidation stability (CEC L-48-A-00, method B, 160° C., 192 h) of inventive examples 2-4 compared to comparative example 5 were checked in SAE 15W40 motor oil formulations (kinematic viscosity at 100° C. to ASTM D445: KV100=12.5-16.3 $mm^2/s$; dynamic viscosity at −20° C. in the cold cranking simulator to ASTM D5293: CCS viscosity <7000 mPAs) as the dispersing viscosity index improver component II. The formation consisted of 5.2% by weight of Chevron-Oronite Paratone 8002 (non-dispersing viscosity index improver component I of the OCP type), dispersing viscosity index improver component II (2.12% by weight polymer content based on formulation), 0.19% by weight of Viscoplex 1-211 (pour point improver), 13.8% by weight of Chevron-Oronite Oloa 4594 CA (additive package) and 12% by weight of 600N oil, made up to 100% by weight with 150N oil.

In this test, the degree of oxidation is detected by the viscosity rise. The lower the values for $\Delta KV40_{rel}$ or $\Delta KV100_{rel}$ are, the better the oxidation stability and the dispersibility of the polymer. The results obtained are compiled in the table which follows. It is found that the inventive polymers according to example 2-4 have significant advantages with regard to the oxidation stability and dispersibility compared to comparative example 5.

| Dispersing viscosity index improver component II | KV40 [$mm^2/s$] | KV100 {$mm^2/s$] | CCS viscosity at −20° C. [mPas] | $\Delta KV40_{rel}$ [%] | $\Delta KV100_{rel}$ [%] |
|---|---|---|---|---|---|
| 3.54% example 2 | 100.1 | 14.11 | 6405 | 10.0 | 4.5 |
| 3.54% example 3 | 104.0 | 14.71 | 6445 | 8.0 | 3.0 |
| 3.54% example 4 | 111.6 | 15.78 | 6490 | 4.9 (repeat 5.7) | 0.0 (repeat 0.0) |
| 3.72% comparative example 5 | 104.2 | 14.57 | 6636 | 13.0 | 8.4 |

The invention claimed is:

1. A block copolymer obtainable by polymerizing at least one monomer composition which consists of a) from 0 to 40% by weight of at least one ethylenically unsaturated ester compound of the formula (I)

(I)

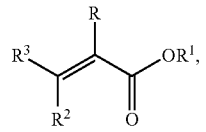

in which R is hydrogen or methyl, $R^1$ is a linear or branched alkyl radical having from 1 to 5 carbon atoms, $R^2$ and $R^3$ are each independently hydrogen or a group of the formula —COOR' in which R' is hydrogen or an alkyl group having from 1 to 5 carbon atoms, b) from 10 to 99.9% by weight of at least one ethylenically unsaturated ester compound of the formula (II)

(II)

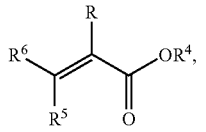

in which R is hydrogen or methyl, $R^4$ is a linear or branched alkyl radical having from 6 to 15 carbon atoms, $R^5$ and $R^6$ are each independently hydrogen or a group of the formula —COOR" in which R" is hydrogen or an alkyl group having from 6 to 15 carbon atoms, c) from 0 to 80% by weight of at least one ethylenically unsaturated ester compound of the formula (III)

(III)

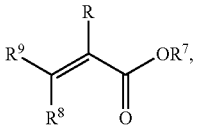

in which R is hydrogen or methyl, $R^7$ is a linear or branched alkyl radical having from 16 to 30 carbon atoms, $R^8$ and $R^9$ are each independently hydrogen or a group of the formula —COOR'" in which R'" is hydrogen or an alkyl group having from 16 to 30 carbon atoms, d) from 0.1 to 30% by weight of at least one ethylenically unsaturated, polar ester compound of the formula (IV)

(IV)

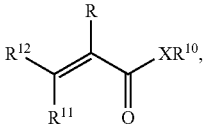

in which R is hydrogen or methyl, X is oxygen, sulfur or an amino group of the formula —NH— or —$NR^a$— in which $R^a$ is an alkyl radical having from 1 to 40 carbon atoms, $R^{10}$ is a radical which comprises from 2 to 1000 carbon atoms and has at least 2 heteroatoms, $R^{11}$ and $R^{12}$ are each independently hydrogen or a group of the formula —COX'$R^{10'}$ in which X' is oxygen or an amino group of the formula —NH— or —$NR^{a'}$— in which $R^{a'}$ is an alkyl radical having from 1 to 40 carbon atoms, and $R^{10'}$ is a radical comprising from 1 to 100 carbon atoms, e) from 0 to 50% by weight of comonomer, based in each case on the total weight of the ethylenically unsaturated monomers;

wherein said compound of the formula (IV) comprises at least one group of the formula —CO— which is a carbonyl group of a ketone, an aldehyde, a urea group containing (meth)acrylate or mixtures thereof.

2. The block copolymer as claimed in claim 1, wherein the block copolymer has a specific viscosity $\eta_{sp/c}$, measured in chloroform at 25° C., in the range from 8 to 74 ml/g.

3. The block copolymer as claimed in claim 1, wherein the $R^{10}$ radical in the ester compounds of the formula (IV) has at least 2 different heteroatoms.

4. The block copolymer as claimed in claim 3, wherein the $R^{10}$ radical in at least one of the ester compounds of the formula (IV) comprises at least one nitrogen atom and at least one oxygen atom.

5. The block copolymer as claimed in claim 1, wherein at least one heteroatom in the $R^{10}$ radical in at least one of the ester compounds of the formula (IV) is separated from the X group by at least 4 atoms.

6. The block copolymer as claimed in claim 1, wherein the $R^{10}$ radical in at least one of the ester compounds of the formula (IV) is a group of the formula (V)

(V)

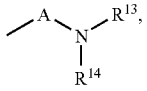

in which A is a connecting group having from 1 to 500 carbon atoms and the $R^{13}$ and $R^{14}$ radicals are each independently hydrogen or an alkyl group having from 1 to 40 carbon atoms.

7. The block copolymer as claimed in claim 6, wherein the connecting group in formula (V) is a group of the formula (VI)

(VI)

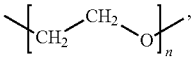

in which n is an integer in the range from 1 to 3.

8. The block copolymer as claimed in claim 7, wherein the $R^{10}$ radical in at least one ester compound of the formula (IV) is a group of the formula (VII)

(VII)

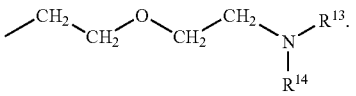

9. The block copolymer as claimed in claim 8, wherein component d) comprises at least one ester compound of the formula (VIII)

(VIII)

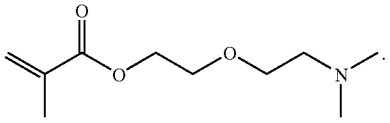

10. The block copolymer as claimed in claim 1, wherein the $R^{10}$ radical in at least one of the ester compounds of the formula (IV) comprises at least 2 groups of the formula —CO—.

11. The block copolymer as claimed in claim 10, wherein the at least two groups of the formula —CO— are bonded to one another via at most 4 atoms, based on the carbon atom of the CO group.

12. A copolymer obtainable by polymerizing at least one monomer composition which consists of a) from 0 to 40% by weight of at least one ethylenically unsaturated ester compound of the formula (I)

(I)

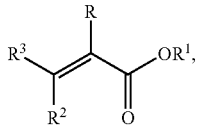

in which R is hydrogen or methyl, $R^1$ is a linear or branched alkyl radical having from 1 to 5 carbon atoms, $R^2$ and $R^3$ are each independently hydrogen or a group of the formula —COOR' in which R' is hydrogen or an alkyl group having from 1 to 5 carbon atoms, b) from 10 to 99.9% by weight of at least one ethylenically unsaturated ester compound of the formula (II)

(II)

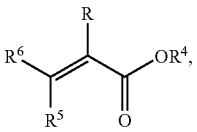

in which R is hydrogen or methyl, $R^4$ is a linear or branched alkyl radical having from 6 to 15 carbon atoms, $R^5$ and $R^6$ are each independently hydrogen or a group of the formula —COOR" in which R" is hydrogen or an alkyl group having from 6 to 15 carbon atoms, c) from 0 to 80% by weight of at least one ethylenically unsaturated ester compound of the formula (III)

(III)

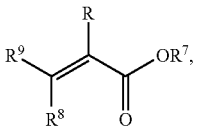

in which R is hydrogen or methyl, $R^7$ is a linear or branched alkyl radical having from 16 to 30 carbon atoms, $R^8$ and $R^9$ are each independently hydrogen or a group of the formula —COOR'" in which R'" is hydrogen or an alkyl group having from 16 to 30 carbon atoms, d) from 0.1 to 30% by weight of at least one ethylenically unsaturated, polar ester compound of the formula (IV)

(IV)

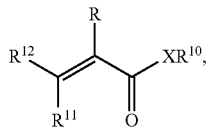

in which R is hydrogen or methyl, X is oxygen, sulfur or an amino group of the formula —NH— or —$NR^a$— in which $R^a$ is an alkyl radical having from 1 to 40 carbon atoms, $R^{10}$ is a radical which comprises from 2 to 1000 carbon atoms and has at least 2 heteroatoms, $R^{11}$ and $R^{12}$ are each independently hydrogen or a group of the formula —COX'$R^{10'}$ in which X' is oxygen or an amino group of the formula —NH— or —$NR^{a'}$— in which $R^{a'}$ is an alkyl radical having from 1 to 40 carbon atoms, and $R^{10'}$ is a radical comprising from 1 to 100 carbon atoms, e) from 0 to 50% by weight of comonomer, based in each case on the total weight of the ethylenically unsaturated monomers;

wherein the $R^{10}$ radical in at least one ester compound of the formula (IV) is a group of the formula (IX)

(IX)

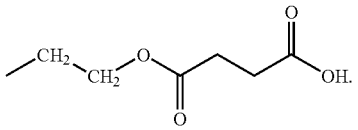

13. The copolymer as claimed in claim 12, wherein component d) comprises at least one ester compound of the formula (X)

(X)

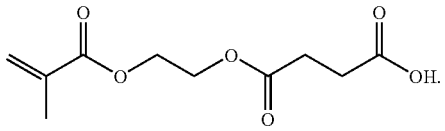

14. A copolymer obtainable by polymerizing at least one monomer composition which consists of a) from 0 to 40% by weight of at least one ethylenically unsaturated ester compound of the formula (I)

(I)

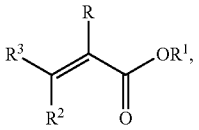

in which R is hydrogen or methyl, $R^1$ is a linear or branched alkyl radical having from 1 to 5 carbon atoms, $R^2$ and $R^3$ are each independently hydrogen or a group of the formula —COOR' in which R' is hydrogen or an alkyl group having from 1 to 5 carbon atoms, b) from 10 to 99.9% by weight of at least one ethylenically unsaturated ester compound of the formula (II)

(II)

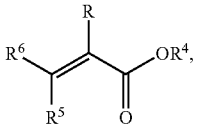

in which R is hydrogen or methyl, $R^4$ is a linear or branched alkyl radical having from 6 to 15 carbon atoms, $R^5$ and $R^6$ are each independently hydrogen or a group of the formula —COOR" in which R" is hydrogen or an alkyl group having from 6 to 15 carbon atoms, c) from 0 to 80% by weight of at least one ethylenically unsaturated ester compound of the formula (III)

(III)

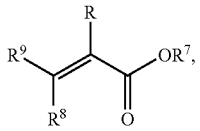

in which R is hydrogen or methyl, $R^7$ is a linear or branched alkyl radical having from 16 to 30 carbon atoms, $R^8$ and $R^9$ are each independently hydrogen or a group of the formula —COOR'" in which R'" is hydrogen or an alkyl group having from 16 to 30 carbon atoms, d) from 0.1 to 30% by weight of at least one ethylenically unsaturated, polar ester compound of the formula (IV)

(IV)

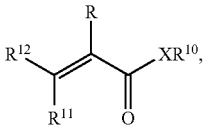

in which R is hydrogen or methyl, X is oxygen, sulfur or an amino group of the formula —NH— or —$NR^a$— in which $R^a$ is an alkyl radical having from 1 to 40 carbon atoms, $R^{10}$ is a radical which comprises from 2 to 1000 carbon atoms and has at least 2 heteroatoms, $R^{11}$ and $R^{12}$ are each independently hydrogen or a group of the formula —COX'$R^{10'}$ in which X' is oxygen or an amino group of the formula —NH— or —$NR^{a'}$— in which $R^{a'}$ is an alkyl radical having from 1 to 40 carbon atoms, and $R^{10'}$ is a radical comprising from 1 to 100 carbon atoms, e) from 0 to 50% by weight of comonomer, based in each case on the total weight of the ethylenically unsaturated monomers;

wherein the $R^{10}$ radical in at least one ester compound of the formula (IV) is a group of the formula (XI)

(XI)

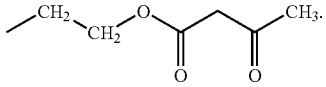

15. The copolymer as claimed in claim 14, wherein component d) comprises at least one ester compound of the formula (XII)

(XII)

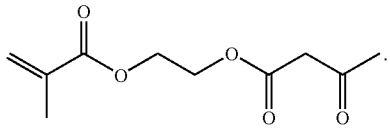

16. The block copolymer as claimed in claim 1, wherein the $R^{10}$ radical in at least one of the ester compounds of the formula (IV) comprises at least one group of the formula —CO— and at least one nitrogen atom.

17. The block copolymer as claimed in claim 16, wherein the $R^{10}$ radical in at least one of the ester compounds of the formula (IV) comprises at least one urea group.

18. The block copolymer as claimed in claim 17, wherein the $R^{10}$ radical in at least one ester compound of the formula (IV) is a group of the formula (XIII)

(XIII)

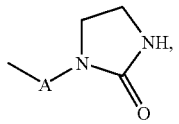

in which A is a connecting group having from 1 to 500 carbon atoms.

19. A block copolymer obtainable by polymerizing at least one monomer composition which consists of a) from 0 to 40% by weight of at least one ethylenically unsaturated ester compound of the formula (I)

(I)

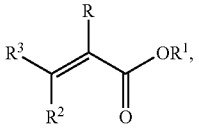

in which R is hydrogen or methyl, $R^1$ is a linear or branched alkyl radical having from 1 to 5 carbon atoms, $R^2$ and $R^3$ are each independently hydrogen or a group of the formula —COOR' in which R' is hydrogen or an alkyl group having from 1 to 5 carbon atoms, b) from 10 to 99.9% by weight of at least one ethylenically unsaturated ester compound of the formula (II)

(II)

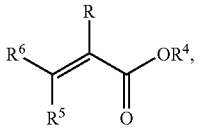

in which R is hydrogen or methyl, $R^4$ is a linear or branched alkyl radical having from 6 to 15 carbon atoms, $R^5$ and $R^6$ are each independently hydrogen or a group of the formula —COOR" in which R" is hydrogen or an alkyl group having from 6 to 15 carbon atoms, c) from 0 to 80% by weight of at least one ethylenically unsaturated ester compound of the formula (III)

(III)

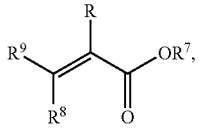

in which R is hydrogen or methyl, $R^7$ is a linear or branched alkyl radical having from 16 to 30 carbon atoms, $R^8$ and $R^9$ are each independently hydrogen or a group of the formula —COOR'" in which R'" is hydrogen or an alkyl group having from 16 to 30 carbon atoms, d) from 0.1 to 30% by weight of at least one ethylenically unsaturated, polar ester compound of the formula (IV)

(IV)

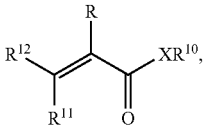

in which R is hydrogen or methyl, X is oxygen, sulfur or an amino group of the formula —NH— or —$NR^a$— in which $R^a$ is an alkyl radical having from 1 to 40 carbon atoms, $R^{10}$ is a radical which comprises from 2 to 1000 carbon atoms and has at least 2 heteroatoms, $R^{11}$ and $R^{12}$ are each independently hydrogen or a group of the formula —COX'$R^{10'}$ in which X' is oxygen or an amino group of the formula —NH— or —$NR^{a'}$— in which $R^{a'}$ is an alkyl radical having from 1 to 40 carbon atoms, and $R^{10'}$ is a radical comprising from 1 to 100 carbon atoms, e) from 0 to 50% by weight of comonomer, based in each case on the total weight of the ethylenically unsaturated monomers;

wherein component d) comprises at least one ester compound of the formula (XIV)

(XIV)

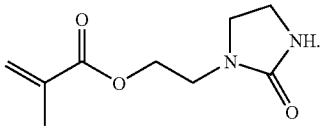

20. The block copolymer as claimed in claim 1, wherein the block copolymer has a polydispersity $M_w/M_n$ in the range from 1.05 to 4.0.

21. The block copolymer as claimed in claim 1, wherein the block copolymer comprises at least one hydrophobic segment P and at least one polar segment D, the hydrophobic segment being obtained by polymerizing a monomer composition which comprises a) from 0 to 40% by weight, based on the weight of the monomer compositions for preparing the hydrophobic segments, of at least one ethylenically unsaturated ester compound of the formula (I)

(I)

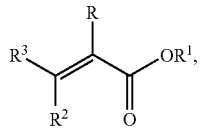

in which R is hydrogen or methyl, $R^1$ is a linear or branched alkyl radical having from 1 to 5 carbon atoms, $R^2$ and $R^3$ are each independently hydrogen or a group of the formula —COOR' in which R' is hydrogen or an alkyl group having from 1 to 5 carbon atoms, b) from 10 to 99.9% by weight, based on the weight of the monomer compositions for preparing the hydrophobic segments, of at least one ethylenically unsaturated ester compound of the formula (II)

(II)

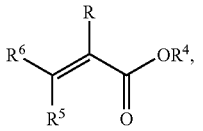

in which R is hydrogen or methyl, $R^4$ is a linear or branched alkyl radical having from 6 to 15 carbon atoms, $R^5$ and $R^6$ are each independently hydrogen or a group of the formula —COOR" in which R" is hydrogen or an alkyl group having from 6 to 15 carbon atoms, c) from 0 to 80% by weight, based on the weight of the monomer compositions for preparing the hydrophobic segments, of at least one ethylenically unsaturated ester compound of the formula (III)

(III)

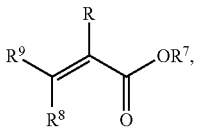

in which R is hydrogen or methyl, $R^7$ is a linear or branched alkyl radical having from 16 to 30 carbon atoms, $R^8$ and $R^9$ are each independently hydrogen or a group of the formula —COOR'" in which R'" is hydrogen or an alkyl group having from 16 to 30 carbon atoms, e) from 0 to 50% by weight, based on the weight of the monomer compositions for preparing the hydrophobic segments, of comonomer, and the polar segment comprising units derived from ethylenically unsaturated, polar ester compounds of the formula (IV)

(IV)

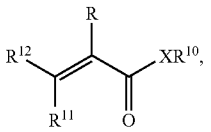

in which R is hydrogen or methyl, X is oxygen, sulfur or an amino group of the formula —NH— or —$NR^a$— in which $R^a$ is an alkyl radical having from 1 to 40 carbon atoms, $R^{10}$ is a radical which comprises from 2 to 1000 carbon atoms and has at least 2 heteroatoms, $R^{11}$ and $R^{12}$ are each independently hydrogen or a group of the formula —COX'$R^{10'}$ in which X' is oxygen or an amino group of the formula —NH— or —$NR^{a'}$— in which $R^{a'}$ is an alkyl radical having from 1 to 40 carbon atoms, and $R^{10'}$ is a radical comprising from 1 to 100 carbon atoms, wherein at least one polar segment comprises at least 3 units which are derived from monomers of the formula (IV) and are bonded directly to one another;

wherein said compound of the formula (IV) comprises at least one group of the formula —CO— which is a carbonyl group of a ketone, an aldehyde, a urea group containing (meth)acrylate or mixtures thereof.

22. The block copolymer as claimed in claim 21, wherein the hydrophobic segment P has a weight-average degree of polymerization in the range from 20 to 5000.

23. The block copolymer as claimed in claim 21, wherein the polar segment D has a weight-average degree of polymerization in the range from 3 to 1000.

24. The block copolymer as claimed in claim 21, wherein at least one polar segment comprises at least 50% by weight, based on the weight of the polar segment, of units derived from monomers of the formula (IV).

25. The block copolymer as claimed in claim 21, wherein the weight ratio of the hydrophobic segments to the polar segments is in the range from 100:1 to 1:1.

26. A lubricant oil composition comprising at least one block copolymer as claimed in claim 1.

27. The lubricant oil composition as claimed in claim 26, wherein the lubricant oil composition comprises at least one mineral oil and/or a synthetic oil.

28. The copolymer as claimed in claim 12, which is a block copolymer.

29. The copolymer as claimed in claim 14, which is a block copolymer.

30. The copolymer as claimed in claim 18, which is a block copolymer.

31. The copolymer as claimed in claim 1, wherein said comonomer is (i) a hydroxyalkyl(meth)acrylate selected from 2-hydroxymethyl(meth)acrylate and 2-hydroxyethyl-methacrylate, or (ii) (meth)acrylic acid.

32. The copolymer as claimed in claim 12, wherein said comonomer is (i) a hydroxyalkyl(meth)acrylate selected from 2-hydroxymethyl(meth)acrylate and 2-hydroxyethyl-methacrylate, or (ii) (meth)acrylic acid.

33. The copolymer as claimed in claim 14, wherein said comonomer is (i) a hydroxyalkyl(meth)acrylate selected from 2-hydroxymethyl(meth)acrylate and 2-hydroxyethyl-methacrylate, or (ii) (meth)acrylic acid.

34. The copolymer as claimed in claim 18, wherein said comonomer is (i) a hydroxyalkyl(meth)acrylate selected from 2-hydroxymethyl(meth)acrylate and 2-hydroxyethyl-methacrylate, or (ii) (meth)acrylic acid.

35. The copolymer as claimed in claim 19, wherein said comonomer is (i) a hydroxyalkyl(meth)acrylate selected from 2-hydroxymethyl(meth)acrylate and 2-hydroxyethyl-methacrylate, or (ii) (meth)acrylic acid.

* * * * *